US008220209B2

(12) United States Patent
Roy et al.

(10) Patent No.: US 8,220,209 B2
(45) Date of Patent: Jul. 17, 2012

(54) GROUND ANCHOR

(75) Inventors: Claude Roy, Laval (CA); Pierre Belanger, Montreal (CA); Lionel Sindt, Montreal (CA); Luc Gionet, Longvevil (CA)

(73) Assignee: Ville de Montreal, Montreal, Quebec (CA)

( * ) Notice: Subject to any disclaimer, the term of this patent is extended or adjusted under 35 U.S.C. 154(b) by 248 days.

(21) Appl. No.: 12/056,056

(22) Filed: Mar. 26, 2008

(65) Prior Publication Data

US 2009/0007502 A1 Jan. 8, 2009

Related U.S. Application Data

(60) Provisional application No. 60/907,193, filed on Mar. 26, 2007.

(51) Int. Cl.
*E02D 5/74* (2006.01)

(52) U.S. Cl. ..... 52/156; 52/159; 119/790; 248/499; 248/509

(58) Field of Classification Search ..... 52/155, 52/156, 159; 117/788, 790; 405/244; 248/499, 248/508, 509; 119/788, 790
See application file for complete search history.

(56) References Cited

U.S. PATENT DOCUMENTS

| | | | | |
|---|---|---|---|---|
| 566,196 | A * | 8/1896 | Lewis | 119/790 |
| 581,065 | A * | 4/1897 | Conner | 119/790 |
| 1,087,567 | A * | 2/1914 | Bartosz | 119/790 |
| 1,120,041 | A * | 12/1914 | Dunn | 119/790 |
| 2,240,083 | A * | 4/1941 | Tondreau | 355/98 |
| 2,713,327 | A * | 7/1955 | West | 119/790 |
| 3,494,587 | A * | 2/1970 | Kuhn | 248/499 |
| 5,476,266 | A | 12/1995 | Caruso | |
| 6,082,697 | A | 7/2000 | Grunfeld | |
| 6,383,096 | B1 | 5/2002 | Green | |
| 6,776,734 | B2 | 8/2004 | van Nimwegen | |
| 2006/0011147 | A1 * | 1/2006 | Krieger | 119/788 |

FOREIGN PATENT DOCUMENTS

| | | |
|---|---|---|
| CA | 1250330 | 2/1989 |
| JP | 07113231 | 5/1995 |
| JP | 09038259 | 2/1997 |
| JP | 11050453 | 2/1999 |
| JP | 2001055739 | 2/2001 |
| JP | 2001241033 | 9/2001 |
| JP | 2002180463 | 6/2002 |
| JP | 2005264650 | 9/2005 |
| WO | 95/23896 | 9/1995 |
| WO | 00/36227 | 6/2000 |

* cited by examiner

*Primary Examiner* — William Gilbert
(74) *Attorney, Agent, or Firm* — Ladas & Parry LLP

(57) ABSTRACT

A ground anchor for anchoring a structure positioned on the ground. The ground anchor comprises a base member, a movable anchoring member and a holding member. The base member is fitted in a hole within the ground and fixedly secured to the ground against removal thereof. The movable anchoring member is mounted to the base member and is movable between a non-anchoring position and an anchoring position. The holding member is mountable to the movable anchoring member when in the anchoring position and to the structure positioned on the ground. When the base member is fixedly secured to the ground, and the movable anchoring member is in the anchoring position with the holding member mounted thereto and to the structure, the ground anchor anchors the structure to the ground. A kit comprising a plurality of such ground anchors is also disclosed.

38 Claims, 11 Drawing Sheets

GROUND ANCHOR

CROSS-REFERENCE TO OTHER APPLICATION

The present application requests priority on U.S. Provisional Application No. 60/907,193 filed on Mar. 26, 2007 and incorporated herein by reference.

FIELD OF THE INVENTION

The present invention relates to a ground anchor. More specifically, but not exclusively, the present invention relates to a ground anchor for soccer goals and the like.

BACKGROUND OF THE INVENTION

Ground anchors are well known and are used for a variety of purposes from securing posts, sports equipment, soccer goals and a variety of other structures.

Conventional ground anchors are not convenient for certain structures such as soccer goals, for example U-bolts on the base of a soccer goal do not provide sufficient force, whereas, J-bolts, eye-bolts and other like anchor rods are dangerous since they protrude from the field when not in use.

OBJECTS OF THE INVENTION

An object of the present invention is to provide a ground anchor.

SUMMARY OF THE INVENTION

In accordance with an aspect of the present invention, there is provided a ground anchor for anchoring a structure positioned on the ground, the ground anchor comprising: a base member for being fitted in a hole within the ground and fixedly secured to the ground against removal thereof; a movable anchoring member mounted to the base member and being movable between a non-anchoring position and an anchoring position; and a holding member mountable to the movable anchoring member when in the anchoring position and to the structure positioned on the ground; wherein when the base member is fixedly secured to the ground, and the movable anchoring member is in the anchoring position with the holding member mounted thereto and to the structure, the ground anchor anchors the structure to the ground.

In accordance with an aspect of the present invention, there is provided a ground anchor kit for anchoring a structure positioned on the ground, the ground anchor kit comprising: a plurality of ground anchors, each ground anchor comprising: a base member for being fitted in a hole within the ground and fixedly secured to the ground against removal thereof; a movable anchoring member mounted to the base member and being movable between a non-anchoring position and an anchoring position; and a holding member mountable to the movable anchoring member when in the anchoring position and to the structure positioned on the ground; wherein when each ground anchor is assembled and fixedly secured into to the ground, and the movable anchoring members are in the anchoring position with the holding members mounted thereto and to the structure, the ground anchors anchor the structure to the ground.

In an embodiment, the base member comprises a top part that is generally flush with the ground when the base member is fitted therein.

In an embodiment, the base member top part comprises an opening for the movable anchoring member.

In an embodiment, the movable anchoring member comprises a top part thereof that is generally flush with the base member top part when in the non-anchoring position. In an embodiment, the base member top part and the anchoring member top part provide respective top surfaces that are in close proximity. In an embodiment, at least one of these respective top surfaces is camouflaged so as to seem similar to the surrounding ground surface. In an embodiment, at least one of these respective top surfaces comprises a material selected from the group consisting of shock absorbent material, non-skid material, anti-slip material or any combination thereof.

In an embodiment, the movable anchoring member is movable about the opening so as to be moved out of the opening when in the anchoring position. In an embodiment, the movable anchoring member comprises a stopper so as to be prevented from being removed from the base member when moved towards the anchoring position. In an embodiment, the movable anchoring member comprises an elongate body, the stopper being positioned near the bottom end of the elongate body. In an embodiment, the movable anchoring member comprises an elongate body, the stopper being positioned at the bottom end of the elongate body. In an embodiment, the stopper comprises a disc member that is larger than the base member top part opening.

In an embodiment, the base member top part comprises a top surface providing recesses that border the opening.

In an embodiment, the base member comprises a bottom end thereof comprising draining apertures.

In an embodiment, the base member comprises a cylindrical configuration.

In an embodiment, the base member comprises a bottom casing and a removable top casing cover. In an embodiment, the top casing cover is fastened to the bottom casing via fasteners. In an embodiment, the top casing cover comprises a hole providing a space for the movable anchoring member. In an embodiment, the hole is centrally located in the top casing cover. In an embodiment, the movable anchoring member is positioned in the bottom casing when in the non-anchoring position. In an embodiment, the top surface of the movable anchoring member is flush with the top surface of the casing cover when in the non-anchoring position. In an embodiment, the bottom end of the movable anchoring member rests on the bottom end of the bottom casing when in the non-anchoring position.

In an embodiment, the movable anchoring member comprises a generally cylindrical configuration.

In an embodiment, the movable anchoring member comprises an elongate body having a top surface and a bottom end thereof. In an embodiment, the elongate body is positioned within the base member when in the non-anchoring position. In an embodiment, at least a portion of this elongate body is positioned outwardly of the base member when in the anchoring position. In an embodiment, this at least a portion of the elongate body is visually distinguishable so as to be visually detectable when positioned outwardly of the base member. In an embodiment, this at least a portion of the elongate body comprises a mounting element for mounting the holding member thereto. In an embodiment, this mounting element comprises a hole. In an embodiment, the holding member is a cable. In an embodiment, the elongate body comprises a stopper so as to be prevented from being removed from the base member when moved outwardly thereof.

In an embodiment, the holding member comprises a locking element. In an embodiment, the holding member comprises a cable and this cable is securely mounted to the structure via a lock.

In an embodiment, the ground anchor further comprises a ground securing assembly mountable to the base member for fixedly securing the base member to the ground against removal thereof. In an embodiment, the ground securing assembly comprises a ground embedding structure mountable to the base member and for being embedded into the ground. In an embodiment, the ground embedding structure comprises pin members. In an embodiment, the base member comprises guiding structures for receiving the pin members providing the pin members to protrude via the bottom of the base member so as to be embedded into the ground. In an embodiment, the guiding structures are formed along the internal wall of the base member. In an embodiment, the pin members are fastened to the guiding structures via fasteners. In an embodiment, the pin members are configured to be embedded into a pile driven into the ground. In an embodiment, the ground securing assembly comprises a support embedded into the ground and fasteners for fastening the base member to the support. In an embodiment, the support comprises a pile.

Other aspects, objects, advantages and features of the present invention will become more apparent upon reading of the following non-restrictive description of non-limiting illustrative embodiments thereof given by way of example only with reference to the accompanying drawings.

DESCRIPTION OF ILLUSTRATIVE EMBODIMENTS

With reference to the appended drawings, illustrative embodiments of the present will be described herein so as to exemplify the invention only and by no means to limit the scope thereof.

Figure 1:
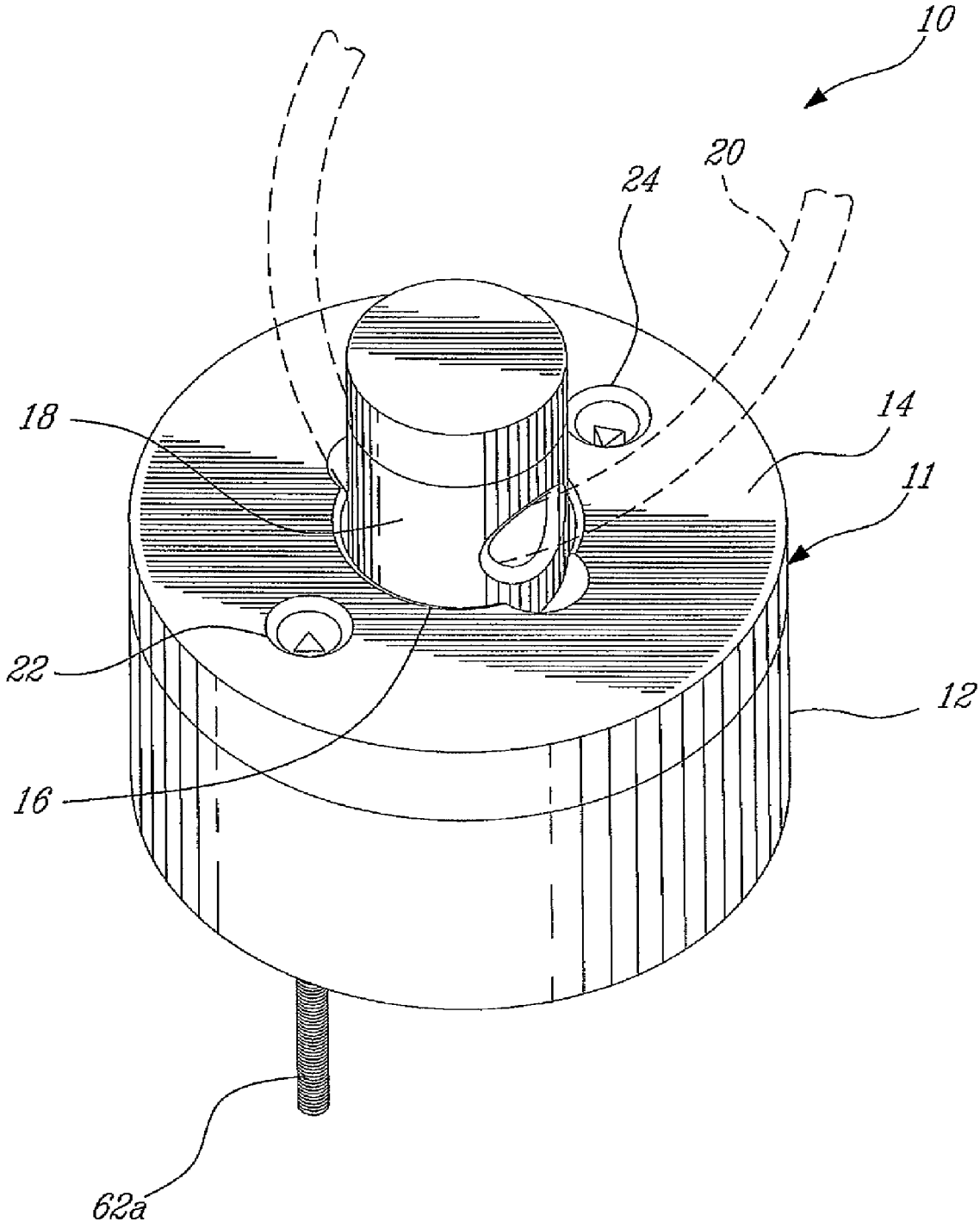
FIG. 1 is a perspective view of the ground anchor of the present invention in accordance with a non-limiting illustrative embodiment thereof.

FIG. 1 shows the ground anchor 10 including a base member 11 having a bottom casing 12 as well as top casing cover 14. The top casing cover 14 includes an opening in the form of central hole 16 providing a space for a movable anchoring member 18 that receives a holding member 20. The holding member can be a locking element such as cable member 20 for mounting on a structure (not shown in this Figure) that is to be anchored. In one non-limiting example, the cable member 20 can be made of strands of steel that are enveloped by vinyl. The cable member 20 can also include loops at its free ends (not shown in this Figure), which can be secured together via a padlock for example.

Figure 2:
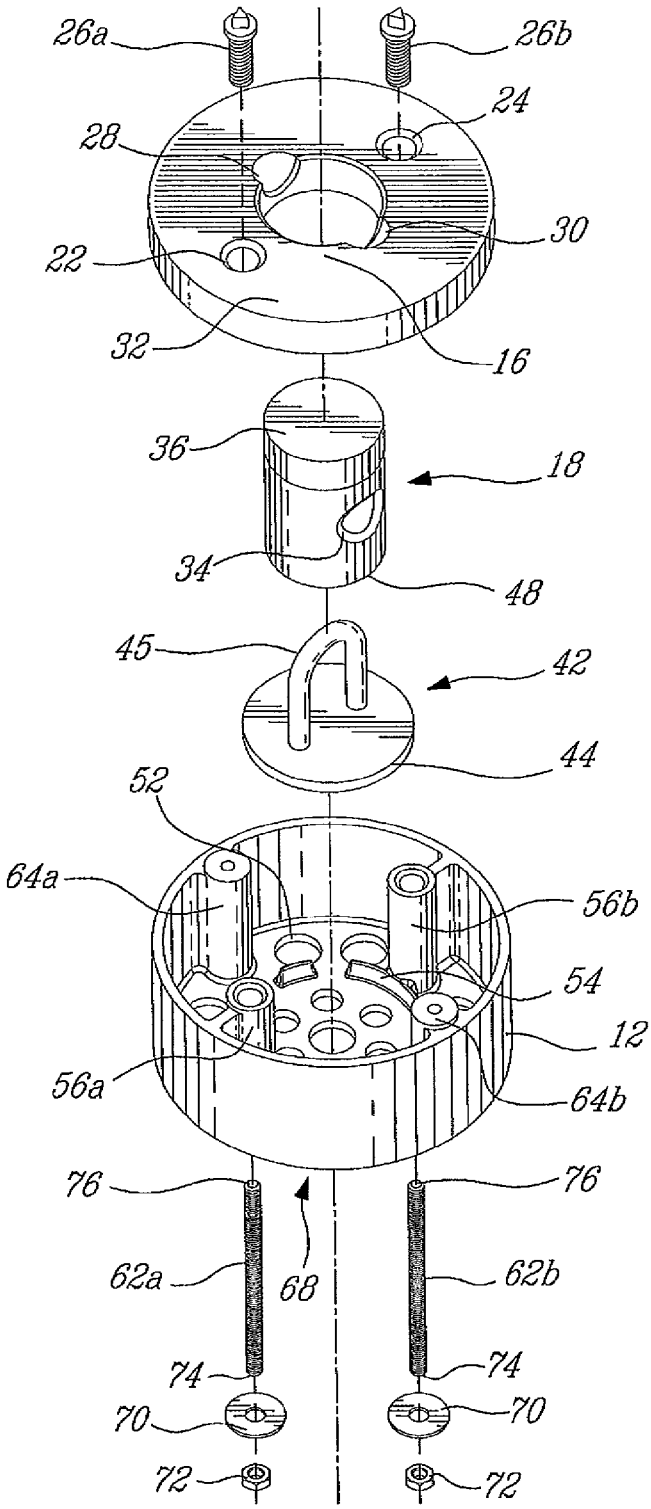
FIG. 2 is a perspective exploded view of the ground anchor of FIG. 1.
Figure 3:
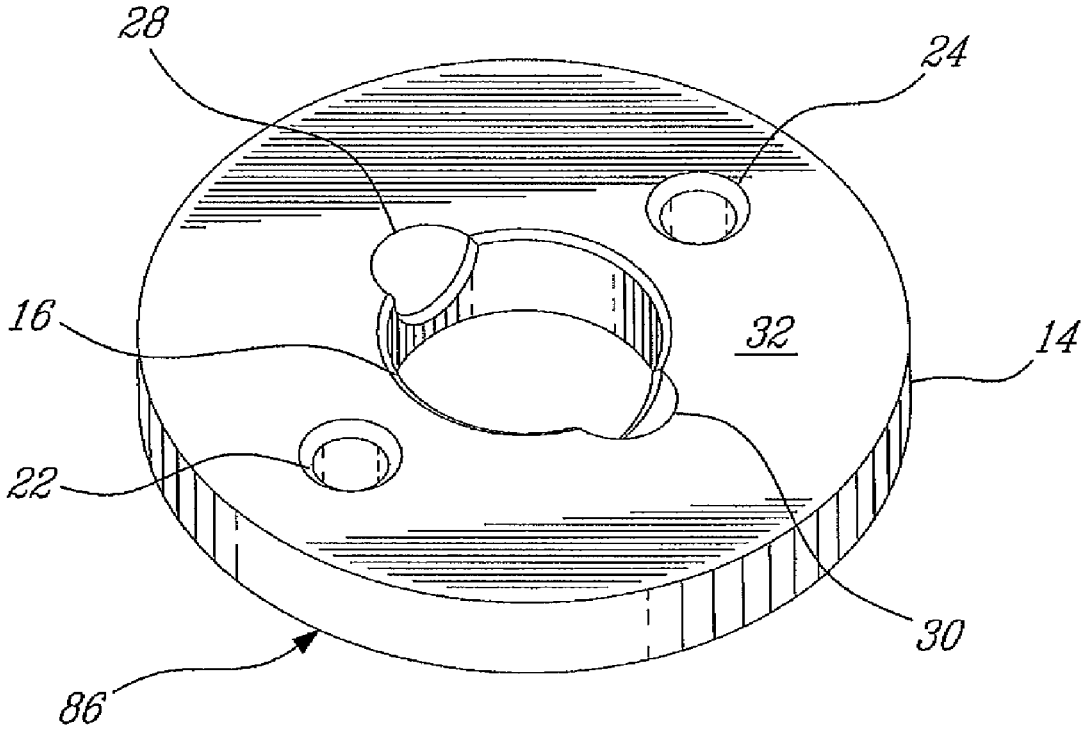
FIG. 3 is perspective view of the casing cover of the present invention in accordance with a non-limiting illustrative embodiment thereof.

With particular reference to FIGS. 2 and 3, the casing cover 14 includes a pair of apertures 22 and 24 for receiving fasteners 26*a* and 26*b* (the function and structure of which will be described herein). A pair of recesses 28 and 30 are formed in the casing cover 14 and border the central hole 16. In one non-limiting example, the top surface 32 of the casing cover 14 can include a shock absorbent non-skid or anti-slip material.

Figure 4:
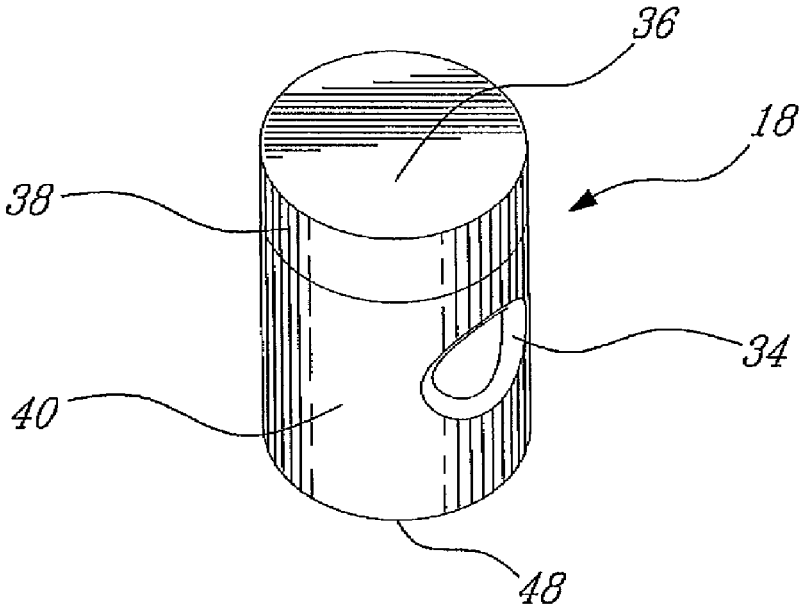
FIG. 4 is perspective view of the anchoring member of the present invention in accordance with a non-limiting illustrative embodiment thereof.

With reference to FIGS. 2 and 4, the anchoring member 18 includes a lateral hole 34 for receiving the cable 20 (as shown in FIG. 1) therethrough. In a non-limiting example, the top surface 36 of the anchoring member 18 can be made of shock absorbent non-skid or anti-slip material similar to that of the top face 32 of the casing cover 14. In fact and as will be explained herein, when the anchoring member 18 is inserted with in casing 12, its top surface 36 is flush with the top surface 32 of the casing cover 14. Furthermore, the upper portion 38 of the anchoring member 18 can be made of a material similar to that of the casing cover 14. Moreover, the lower portion 40 and the top portion 38 can be visually distinguishable, by way of different colors for example, so that when the anchoring member 18 protrudes through hole 16 (as will be explained herein) it will be visually detectable.

Figure 5:
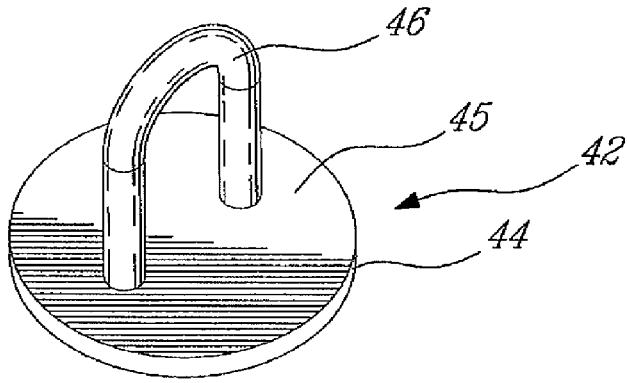
FIG. 5 is perspective view of the anchoring member stopper of the present invention in accordance with a non-limiting illustrative embodiment thereof.

With reference to FIGS. 2 and 5, there is shown a stopper 42 including a circular plate stopping member 44 having a U-shaped top structure 45 on the upper face 46 thereof. The U-shaped top structure 45 is to be inserted within the open bottom end 48 (see also FIG. 4) of the anchoring member 18 as is shown is FIG. 7. The plate member 44 is welded to the anchoring member 18 and has a surface that is larger than hole 16 of the casing cover 14, thereby preventing the removal of the anchoring member 18 from the hole 16 as will be further described herein.

In another embodiment, the anchoring member 18 and the stopper 42 form a single integral piece.

Figure 6:
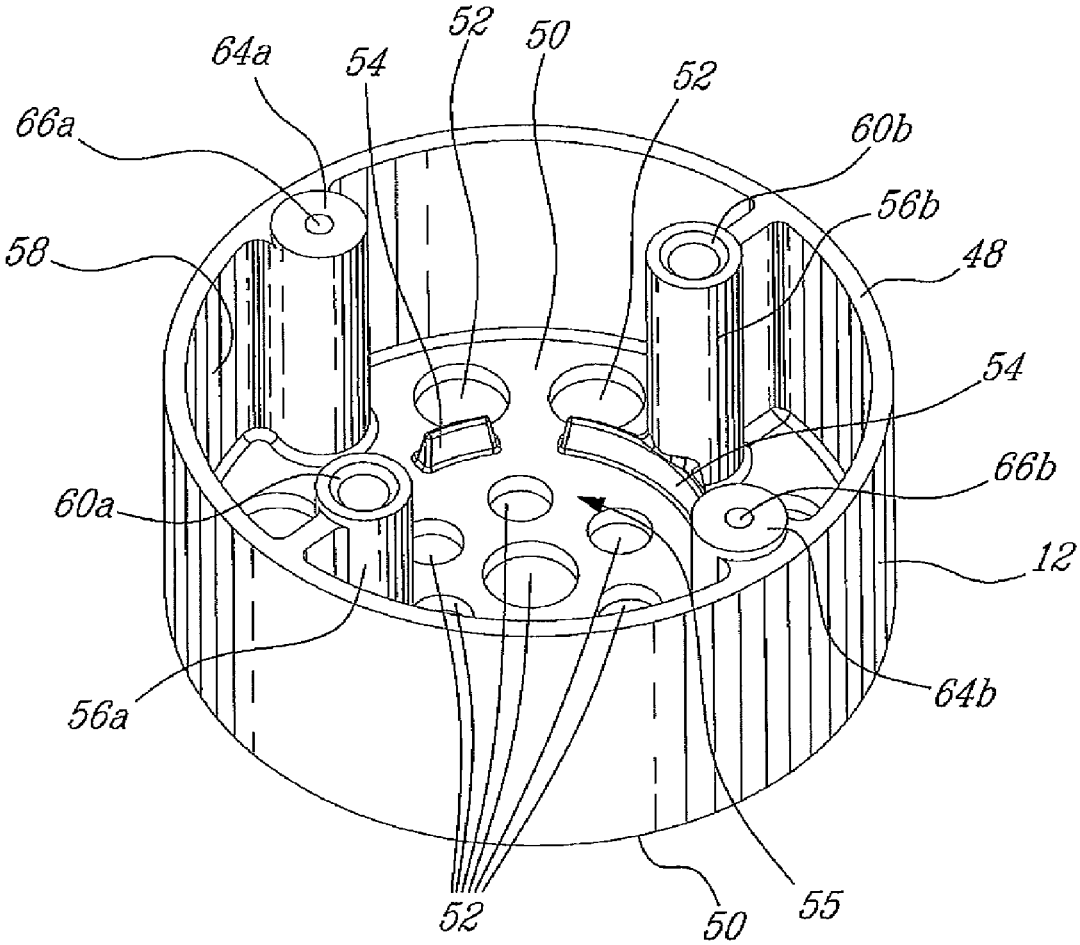
FIG. 6 is perspective view of the casing of the present invention in accordance with a non-limiting illustrative embodiment thereof.
Figure 7:
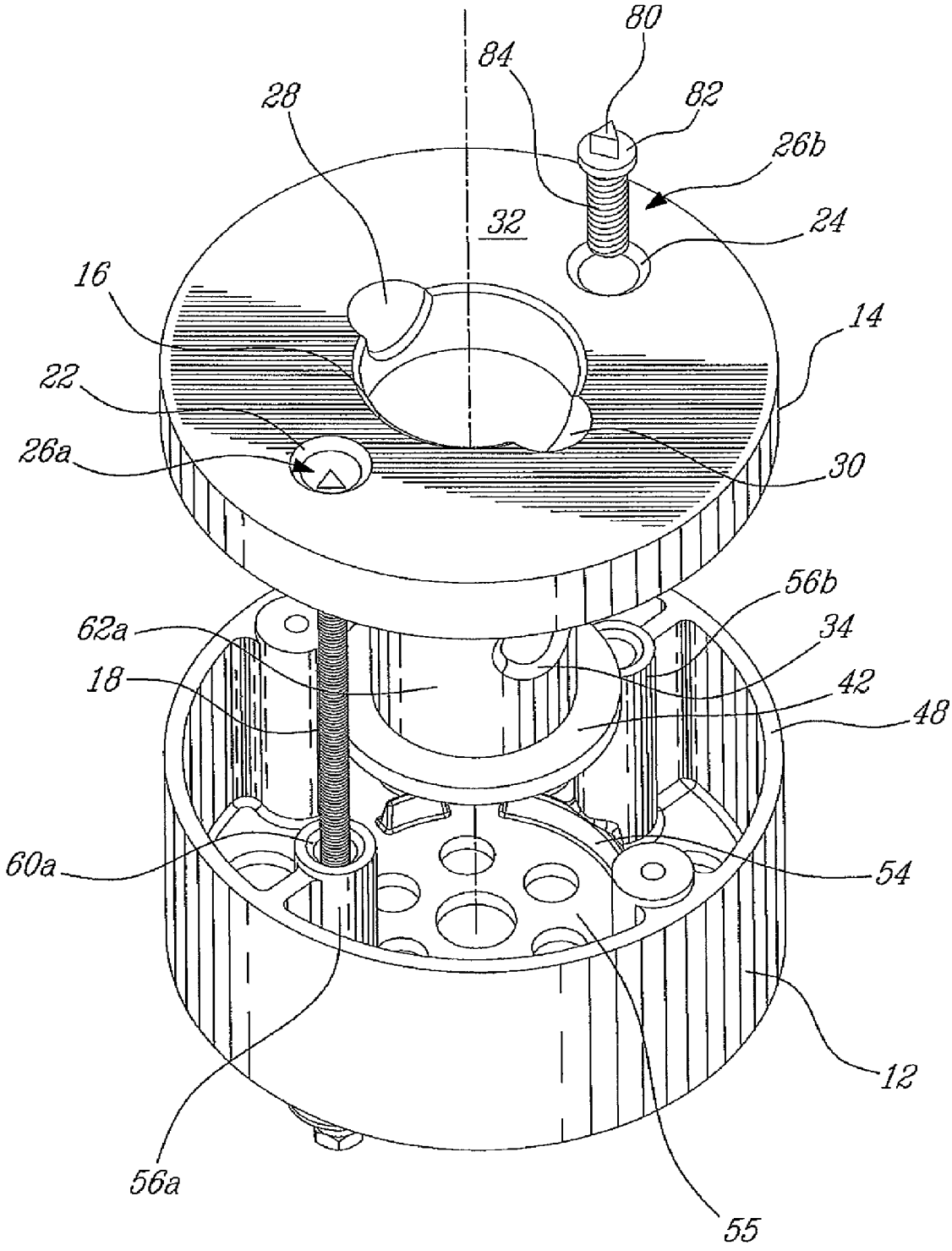
FIG. 7 is a perspective partially assembled view of the ground anchor of FIG. 1.

Referring to FIGS. 2, 6 and 7, the casing 12 includes an open top end 48 as well as a bottom end 50 defined by a floor having a plurality of draining apertures 52. The bottom end 50 also includes positioning elements 54 in the form of circular short wall sections for positioning the stopper 42 within the space 55 defined therebetween. The casing 12 also includes a pair of tubular guiding structures 56*a* and 56*b* that are formed along the internal wall 58 thereof. The guiding structures 56*a* and 56*b* are generally symmetrically disposed and include respective internally threaded bores 60*a* and 60*b* for respectively and complementarily receiving a ground-embedding structure, in this non-limiting example being a pair of leveling pins 62*a* and 62*b* (see FIGS. 1 and 7). Furthermore, the casing 12 also includes a pair of auxiliary tubular structures 64*a* and 64*b*, which are generally symmetrically disposed along inner wall 58 and include respective bores 66*a* and 66*b*.

When installing the ground anchor 10, the user first digs a hole into the ground that is sufficient to fit the casing 12 therein. The hole is deep enough to provide for the top surface 32 of the cover 14 to lie flush with the ground surrounding the hole, thereby providing for a substantially contiguous surface. The leveling pin members 64 are threadedly inserted into the tubular guide structures 56*a* and 56*b* from the rear side 68 (see FIG. 2) of the casing 12. A washer 70 and nut 72 assembly are mounted to each pin member 62*a* and 62*b* so as to fix the pin members 62*a* and 62*b* at a desired level within their respective guide structures 56*a* and 56*b*. The washer 70 and nut 72 assembly can be inserted from the inside (at the bottom end 50) of the casing 12 or from the rear side 68.

The bottom ends 74 of the pin members 62*a* and 62*b* are embedded within a ground surface such as concrete by a variety of ways known in the art. In a non-limiting example, a polypropylene bag or layer of material can be placed in the hole of the ground so as to surround the casing 12 when inserted therein.

As the casing 12 is inserted into the hole, the guide structures 56*a* and 56*b* are respectively guided along pin members 62*a* and 62*b*. Once the casing 12 is installed, the anchoring member 18 is then positioned within the casing 12. More specifically, the plate member 44 of the stopper 42 is positioned within space 55; in this way, the locating elements 54 secure the anchoring member 18 in position. The cover 14 is then mounted on the casing 12 by respectively aligning apertures 22 and 24 with the bores 60*a* and 60*b*. Fasteners 26*a* and 26*b* are then respectively inserted into openings 22 and 24 to be mounted onto the upper ends 76 (see FIG. 2) of the pin members 62*a* and 62*b*.

Referring to FIG. 7 the fasteners 26*a* and 26*b* are barrel nut fasteners having a triangular head 80 and a support collar 82 as well as a connecting section 84. The connecting section 84 is fitted within the bores 60*a* and 60*b* of each guide structure 56*a* and 56*b* and mounted onto the top end 76 (see FIG. 2) of a respective pin members 62*a* or 62*b*. The head 80 is sunk within the apertures 22 and 24 thereby avoiding protrusion thereof beyond cover surface 32. In this way, the cover 14 is locked onto the casing 12 and when the anchoring member 18 is not lifted, surfaces 32 and 36 are flush with the ground surrounding the dug hole. The fasteners 26*a* and 26*b* can be locked into position or unlocked to release the cover 14 via a key member (not shown).

In operation, once the ground anchor 10 has been installed, the user will pull the anchoring element 18 out of the central hole 16 until the stopper 42 abuts the inner side 86 (see FIG. 3) of the casing cover 14. The recesses 28 and 30 provide access for the fingers of a user to lift the anchoring member 18 from its top portion 38. The user can then place the cable 20 within the lateral hole 34 of the anchoring member 18. The cable 20 is then looped around the structure that is to be anchored, such as a soccer goal for example. The loops at the free ends of the cable 20 are locked together via a padlock for example. The anchoring element 18 is released and may fall back into the casing 12 via the central hole 16; this fall though is arrested by the cable 20 which is attached to the structure that is being anchored. When a pressure is applied to the anchored structure, the cable 20 will keep it fixed in its place since cable 20 is immobilized by the stopper 42 which abuts the internal side of the cover 14 thus not allowing the anchoring member 18 to be disassociated from the casing 12. Furthermore, the cover 14 is locked onto the casing 12 via fasteners 26*a* and 26*b* thereby, the cover 14 cannot be disassociated from the casing 12. Finally, the casing 12 itself is locked to the pin members 62*a* and 62*b*, via the washer 70 and nut 72 assembly, with the pin members 62*a* and 62*b* being fixedly embedded in a in-ground surface such as concrete.

In the case of a conventional soccer goal, four such ground anchors 10, which constitute a kit, can be used with the cable 20 looped about the base of the soccer goal, with one ground anchor 10 mounted, via a cable 20, to each lateral side of the soccer goal base and two ground anchors 10 mounted to the back portion of the soccer goal base.

Of course, the present ground anchor can be used to anchor a variety of elements, sports equipment, park fixtures and the like as will be readily understood by a person having skill in the art.

In order to clean the ground anchor 10, the user must unlock the cable 20 from the anchored structure and remove it from the anchoring member 18. The user then removes fasteners 26*a* and 26*b*, via the key member (not shown), thereby allowing the removal of cover 14 from the casing 12. The anchoring member 18 is then removed from the now opened casing 12. In turn, the casing 12 is removed from the ground hole by respectively guiding the tubular structures 56*a* and 56*b* along the pin members 62*a* and 62*b*. The ground anchor 10 is then reassembled as described above. Water within the casing 12 will flow out of the drainage holes 52.

Having now described an illustrative embodiment of the ground anchor 10 in accordance with the present invention other non-limiting alternative embodiments and features thereof will now be discussed so as to further exemplify the invention only.

The casing 12 and cover 14 can be of any type of suitable configuration, such as a cylinder, a rectangle and the like and can be provided in a variety of sizes. The ground anchor 10 can be made of a variety of suitable materials. A variety of different types of bolts or locking mechanisms can be used to lock the cover 14 to the casing 12. A variety of ground securing assemblies can be provided within the scope of the present invention to secure the ground anchor 10 to the ground. For example, the ground-embedding structure can be ground anchoring elements, such as the pin members 62*a* and 62*b*, described above and can be provided in a number of configurations, designs, structures, materials and sizes as will be understood by the skilled artisan. For example, a greater number of pin members can be used. Pin members or extensions having jagged embedding ends can also be provided. Drilling elements can also be useful within the context of the present invention. Various rods and embeddable structures can be contemplated by one having skill in the art, depending on the ground surface, as well as the size, weight and configuration of the structure being anchored, and the force against which the ground anchor 10 needs to act in order to prevent the anchored structure from moving.

In an embodiment, the top surfaces 32 and 36 of the cover 14 and the anchoring member 18 respectively, will be camouflaged so as to emulate the ground surface of a soccer field. Of course, other types of fields and surface areas can also be emulated.

With references FIGS. 8 to 13 a ground anchor 100 in accordance with another illustrative embodiment will now be described to still further exemplify the present invention. It should be noted that ground anchor 100 generally resembles ground anchor 10 as such the following description will pay greater attention to the differences between ground anchors 100 and 10 for concision purposes only.

Figure 8:
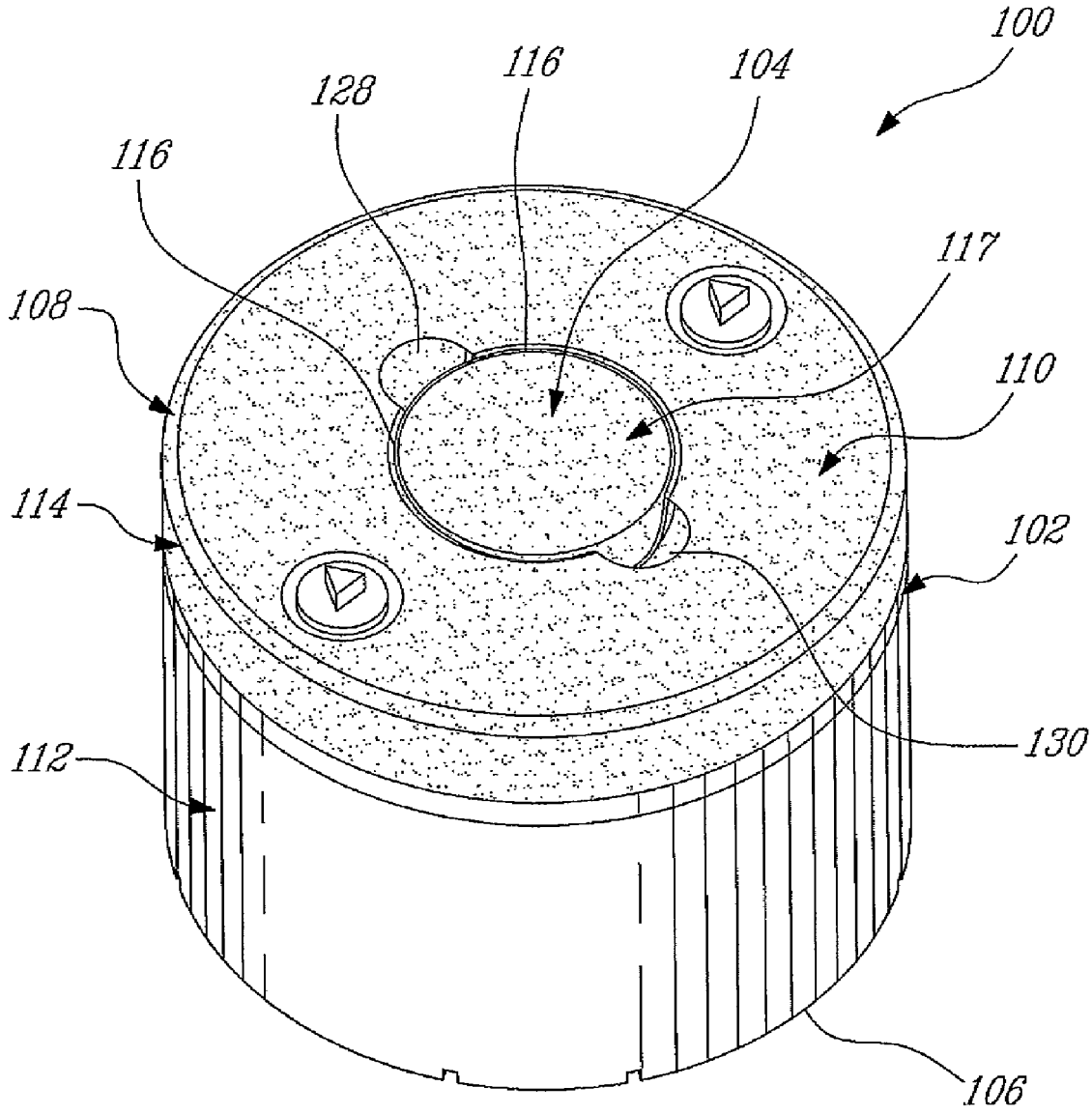
FIG. 8 is a perspective view of the ground anchor of the present invention in accordance with another non-limiting illustrative embodiment thereof, the movable anchoring member being shown in the non-anchoring position.

FIG. 8 shows the ground anchor 100 including a base member 102 and movable anchoring member 104 fitted therein. The base member 102 includes a bottom end 106 and a top end 108 defining a top surface 110. More specifically, the base member 102 includes a bottom casing 112 and top casing cover 114 having an opening 116, with adjacent recesses 128 and 130, for the anchoring member 104. The anchoring member 104 is in the non-anchoring position as such its top surface 117 lies flush with top surface 110.

Figure 9:
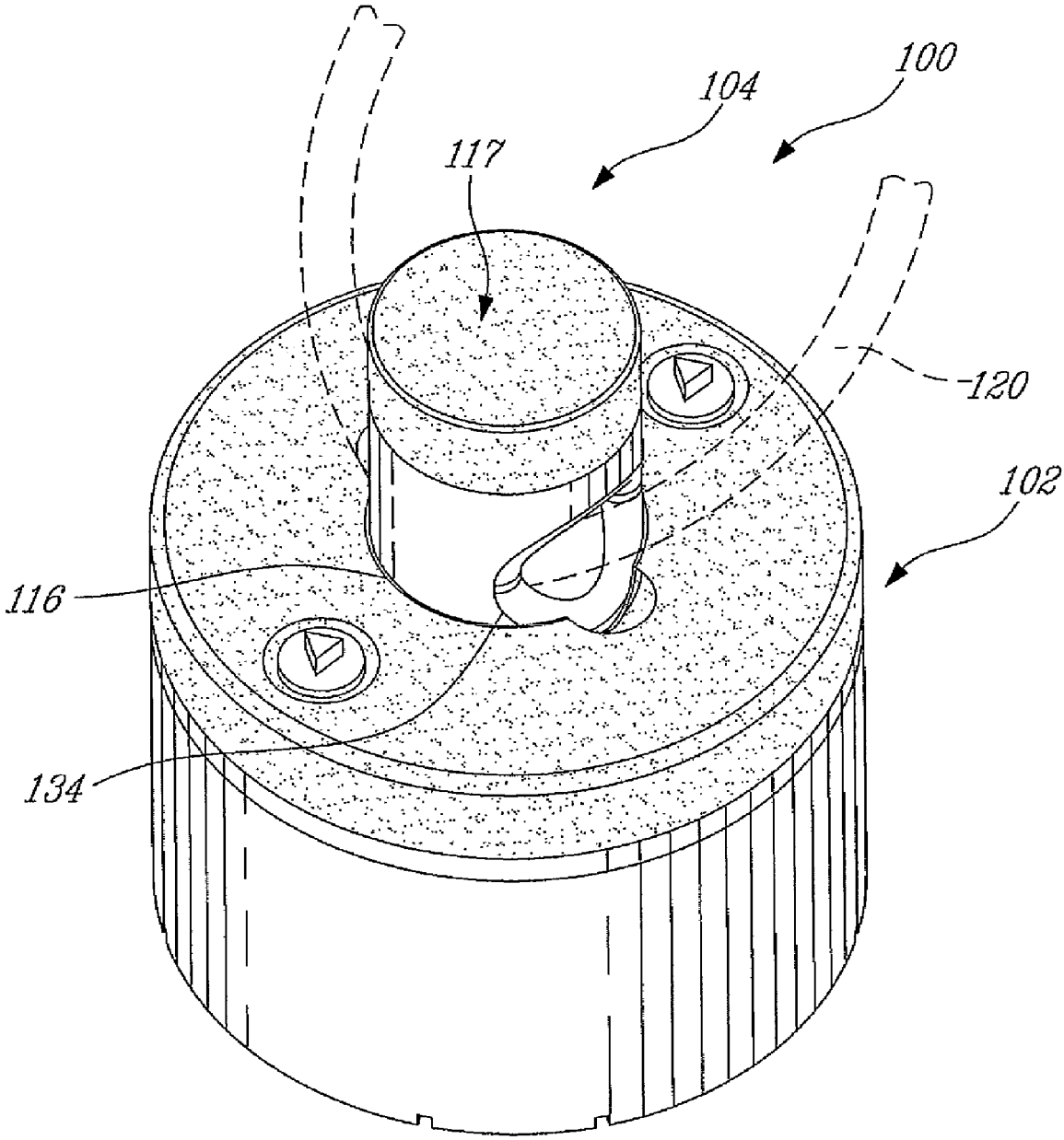
FIG. 9 is the perspective view of FIG. 8 with the movable anchoring member being shown in the anchoring position.

FIG. 9 shows the movable anchoring member 104 in the anchoring position. The movable anchoring member 104 includes a mounting element in the form of lateral hole 134 for mounting a holding member 120 thereto. As previously mentioned the holding member 120 can be a rope, cable or any other type of suitable member for holding a structure S as shown in FIG. 13.

Figure 13:
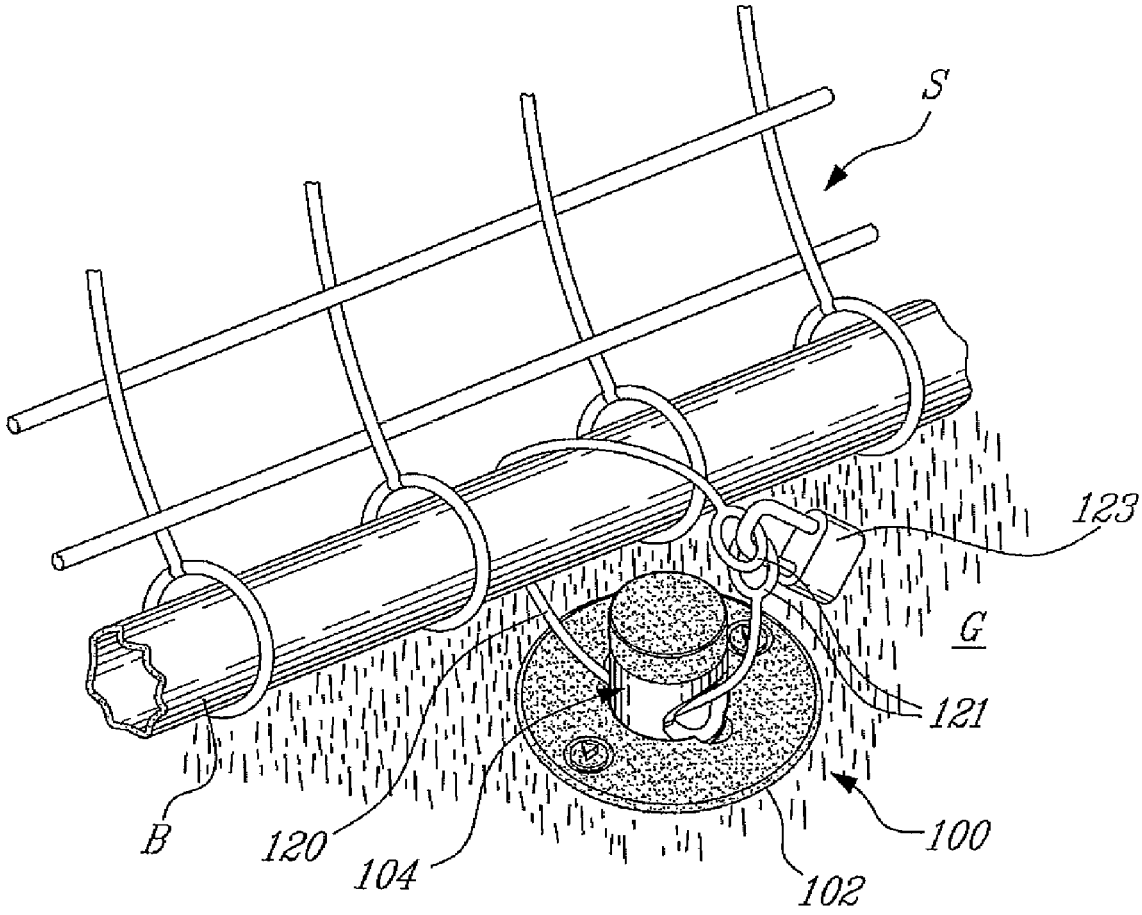
FIG. 13 is a perspective view of the ground anchor of FIG. 8 in operation being fitted within the ground and anchoring a structure such as a soccer goal.

Turning to FIG. 13, the ground anchor 100 is shown with the base member 102 fitted into the ground G so that its top surface 110 lies flush therewith. The movable anchoring member 104 is in the anchoring position and the cable 120 is mounted thereto and to the structure S, which in this example is a soccer goal. More specifically, the cable 120 is looped around the base B of the soccer goal S with its free ends, which include loops 121, being locked together by a lock 123.

Figure 10:
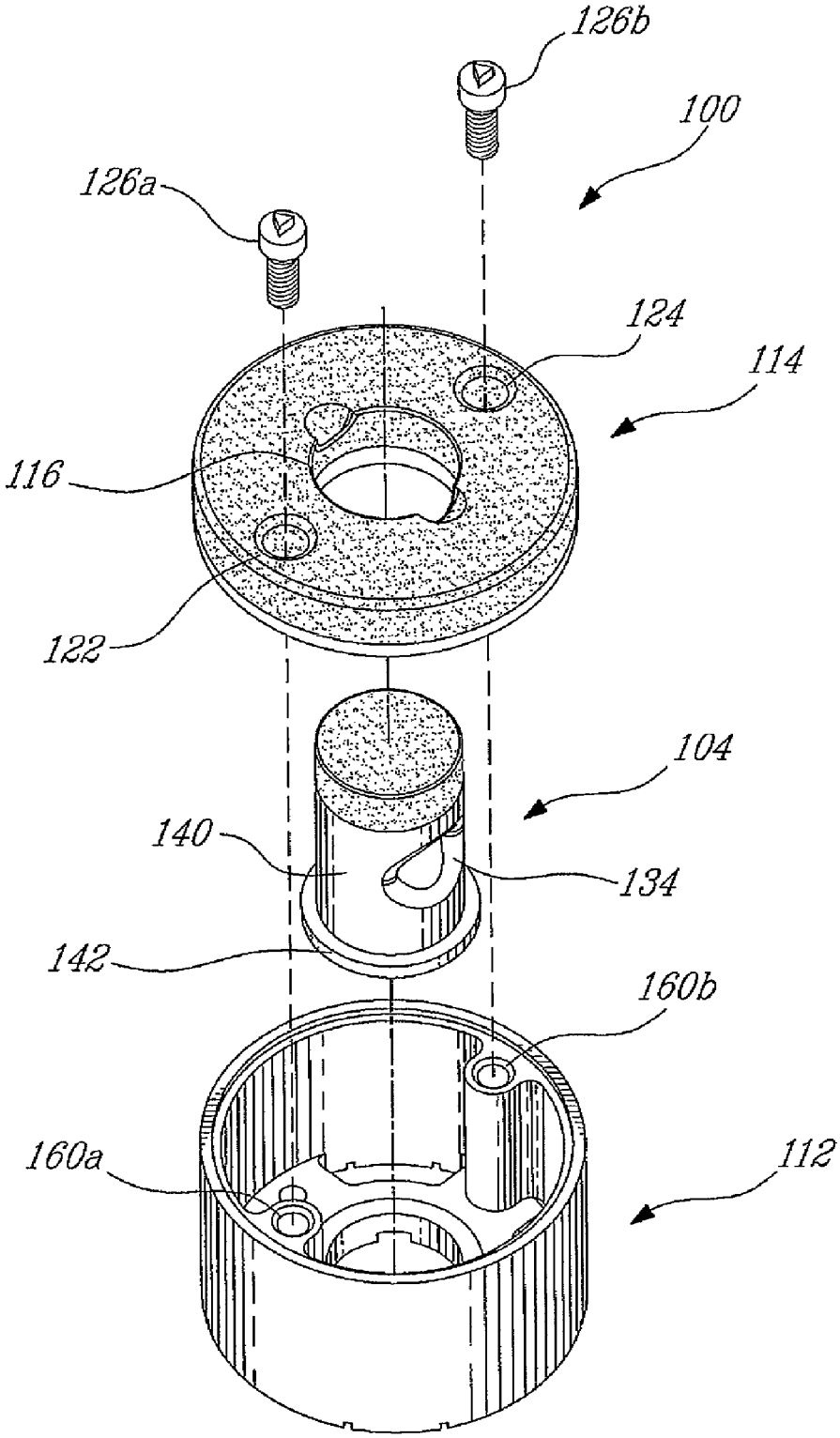
FIG. 10 is an exploded perspective view of the ground anchor of FIG. 8.
Figure 11:
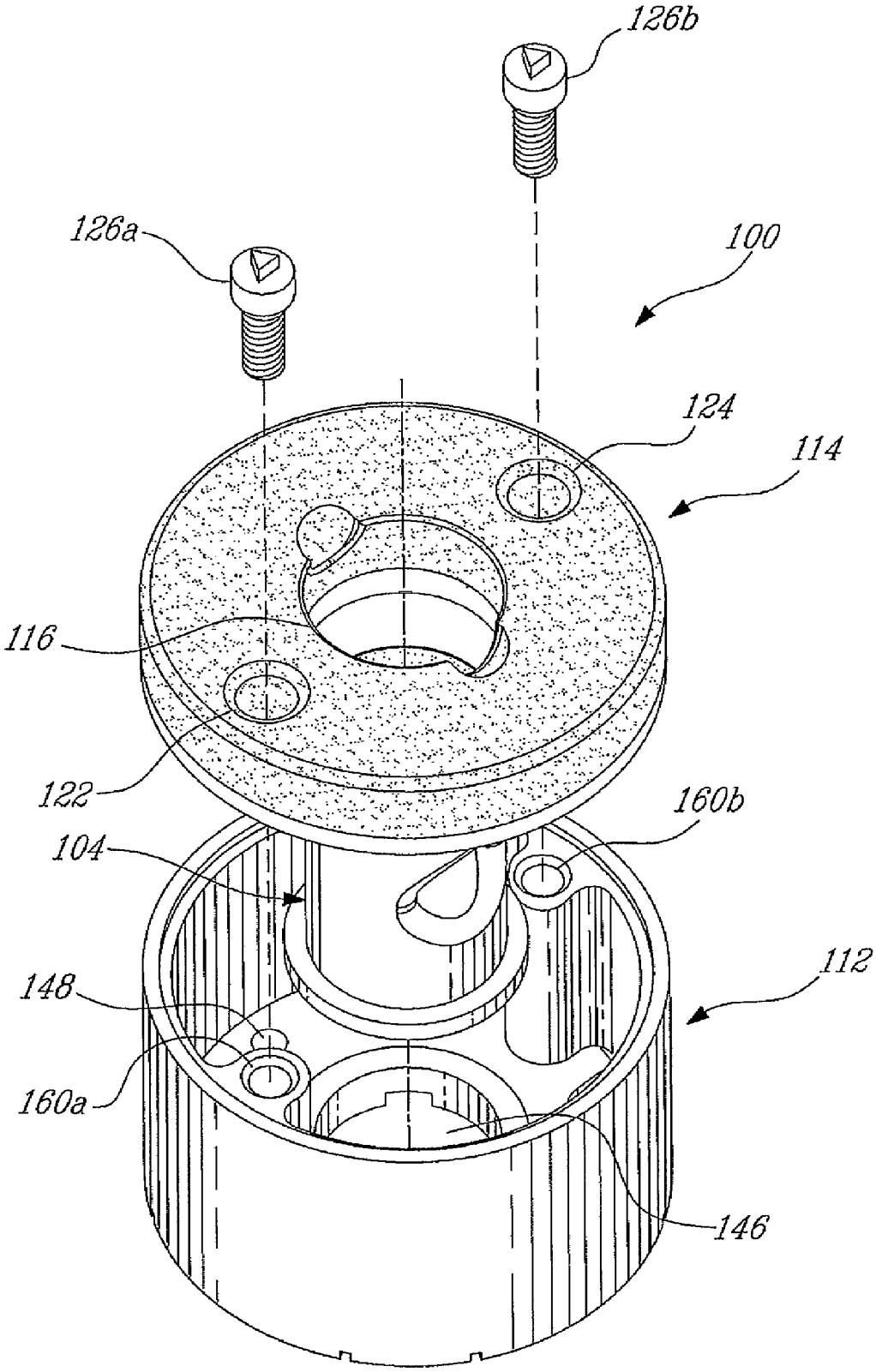
FIG. 11 is another exploded perspective view of the ground anchor of FIG. 8.
Figure 12:
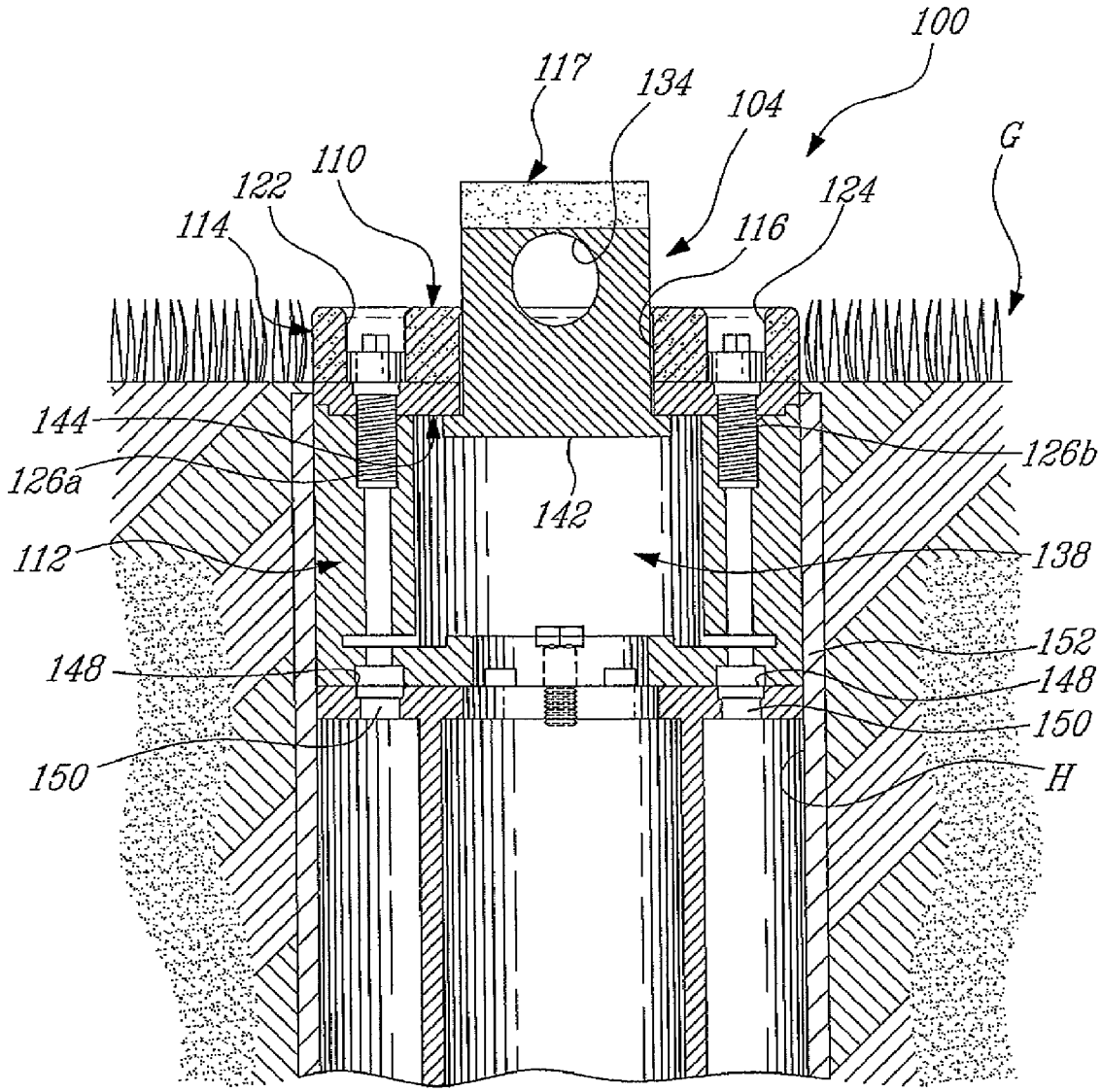
FIG. 12 is a sectional view of the ground anchor of FIG. 8 fitted within the ground.

With reference to FIGS. 10, 11, and 12 the ground anchor 100 is assembled by first positioning the anchoring member 104 within the bottom casing 112. The cover 114 is then mounted on the bottom casing 112 by aligning its apertures 122 and 124 with the complementary bores 160*a* and 160*b* of the bottom casing 122 and attaching the cover to the casing via fasteners 126*a* and 126*b* as shown in FIG. 12.

As shown in FIG. 12, the movable anchoring member 104 can be longitudinally moved within the space 138 provided by the base member 102.

The movable anchoring member 104 is an elongated body 140, having a top end 117 and a bottom end 142 that is in the form of an enlarged disc. As shown in FIG. 12, the bottom end 142 is larger than opening 116 and therefore acts as a stopper against the underside 144 of the cover 114 preventing the movable anchoring member 104 from being removed from the base member 102 when moved in the anchoring position.

With particular reference to FIGS. 10 and 11, the bottom end 106 of the base member 102 includes a draining aperture 146 as well as apertures 148 for a ground-securing assembly which includes pins 150 (see FIG. 12).

Turning now to FIG. 12, when installing the ground anchor 100, the user first digs a hole H into the ground G and then adds a cylindrical guard or pot 152 is embedded into the hole H. The ground securing assembly includes a support such as pile 154 which is driven and embedded within the pot 152 into the ground. The bottom casing 114 is then inserted into the hole H on top of the pile 154. The bottom casing 114 is fastened to the pile 154 via the fastening pins 150. A further fastener 156 can also be used to mount the bottom casing to the pile 154. The movable anchoring element 104 is inserted within space 138 defined by casing 112 and the casing 112 is finally covered by cover 114 which is fastened thereto. The user can then selectively move the movable anchoring element 104 to the anchoring position by gripping it via the space provided by recesses 128 and 130 and proceed to pass the holding element 120 into the hole 134 and mount it on a structure S. When the user releases the movable anchoring element it will remain in the anchoring position since the holding element 120 mounted on the structure S will prevent it from dropping back into the base member 112 as shown in FIG. 13.

It should be noted that the various components and features of the ground anchors 10 and 100 described above can be combined in a variety of ways so as to provide other non-illustrated embodiments within the scope of the invention.

It is to be understood that the invention is not limited in its application to the details of construction and parts illustrated in the accompanying drawings and described hereinabove. The invention is capable of other embodiments and of being practiced in various ways. It is also to be understood that the phraseology or terminology used herein is for the purpose of description and not limitation. Hence, although the present invention has been described hereinabove by way of embodiments thereof, it can be modified, without departing from the spirit, scope and nature of the subject invention described herein.

What is claimed is:

1. A ground anchor for anchoring a structure positioned on the ground, said ground anchor comprising:

a base member for being fitted in a hole within the ground and fixedly secured to the ground against removal thereof, said base member comprising a top part having an opening and defining a generally flat top surface thereof; and a movable anchoring member comprising an elongate body, a top part defining a generally flat top surface thereof and a mounting element positioned on the elongate body and longitudinally spaced apart from the top surface, the mounting element being for mounting a holding member thereto, the movable anchoring member being mounted to said base member via said opening, said movable anchoring member being movable between a non-anchoring position, wherein said movable anchoring member top surface forms a plane with said base member top surface and said mounting element is retracted, and an anchoring position, wherein said movable anchoring member top surface protrudes above said base member top surface and said mounting element is exposed;

wherein mounting the holding member to the mounting element prevents the movable anchoring member from moving from the anchoring position to the non-anchoring position; and wherein when said base member is fixedly secured to the ground, and said movable anchoring member is in said anchoring position with said holding member mounted thereto and to the structure, said ground anchor anchors the structure to the ground.

2. The ground anchor according to claim 1, wherein said base member top surface is flush with the ground when said base member is fitted therein.

3. The ground anchor according to claim 1, wherein at least one of said top surfaces is camouflaged so as to seem similar to the surrounding ground surface.

4. The ground anchor according to claim 1, wherein at least one of said top surfaces comprises a material selected from the group consisting of shock absorbent material, non-skid material, anti-slip material or any combination thereof.

5. The ground anchor according to claim 1, wherein said movable anchoring member is movable about said opening so as to be moved out of said opening when in said anchoring position.

6. The ground anchor according to claim 5, wherein said movable anchoring member comprises a stopper so as to be prevented from being removed from said base member when moved towards said anchoring position.

7. The ground anchor according to claim 6, wherein said stopper is positioned near the bottom end of said elongate body.

8. The ground anchor according to claim 6, wherein said stopper is positioned at the bottom end of said elongate body.

9. The ground anchor according to claim 6, wherein said stopper comprises a disc member that is larger than said base member top part opening.

10. The ground anchor according to claim 1, wherein said base member top part comprises a top surface providing recesses that border said opening.

11. The ground anchor according to claim 1, wherein said base member comprises a bottom end thereof comprising draining apertures.

12. The ground anchor according to claim 1, wherein said base member comprises a cylindrical configuration.

13. The ground anchor according to claim 1, wherein said base member comprises a bottom casing and wherein said base member top part comprises a removable top casing cover.

14. The ground anchor according to claim 13, wherein said top casing cover is fastened to said bottom casing via fasteners.

15. The ground anchor according to claim 13, wherein said top casing cover comprises a hole defining said opening and providing a space for said movable anchoring member.

16. The ground anchor according to claim 15, wherein said hole is centrally located in said top casing cover.

17. The ground anchor according to claim 16, wherein said movable anchoring member is positioned in said bottom casing when in said non-anchoring position.

18. The ground anchor according to claim 17, wherein the bottom end of said movable anchoring member rests on the bottom end of said bottom casing when in said non-anchoring position.

19. The ground anchor according to claim 1, wherein said movable anchoring member comprises a generally cylindrical configuration.

20. The ground anchor according to claim 1, wherein said movable anchoring member comprises a bottom end of the elongate body.

21. The ground anchor according to claim 20, wherein said elongate body is positioned within said base member when in said non-anchoring position.

22. The ground anchor according to claim 21, wherein at least a portion of said elongate body is positioned outwardly of said base member when in said anchoring position.

23. The ground anchor according to claim 22, wherein said at least a portion of said elongate body is visually distinguishable so as to be visually detectable when positioned outwardly of said base member.

24. The ground anchor according to claim 22, wherein said elongate body comprises a stopper so as to be prevented from being removed from said base member when moved outwardly thereof.

25. The ground anchor according to claim 1, wherein said mounting element comprises a hole.

26. The ground anchor according to claim 25, wherein said holding member is a cable.

27. The ground anchor according to claim 1, wherein said holding member comprises a locking element.

28. The ground anchor according to claim 1, wherein said holding member comprises a cable.

29. The ground anchor according to claim 28, wherein said cable is securely mounted to the structure via a lock.

30. The ground anchor according to claim 1, further comprising a ground securing assembly mountable to said base member for fixedly securing said base member to the ground against removal thereof.

31. The ground anchor according to claim 30, wherein said ground securing assembly comprises a support embedded into the ground and fasteners for fastening said base member to said support.

32. The ground anchor according to claim 30, wherein said ground securing assembly comprises a ground embedding structure mountable to said base member and for being embedded into the ground.

33. The ground anchor according to claim 32, wherein said ground embedding structure comprises pin members.

34. The ground anchor according to claim 33, wherein said pin members are configured to be embedded into a pile driven into the ground.

35. The ground anchor according to claim 33, wherein said base member comprises guiding structures for receiving said pin member providing said pin members to protrude via the bottom of said base member so as to be embedded into the ground.

36. The ground anchor according to claim 35, wherein said pin members are fastened to said guiding structures via fasteners.

37. The ground anchor according to claim 35, wherein said guiding structures are formed along the internal wall of said base member.

38. A ground anchor kit for anchoring a structure positioned on the ground, said ground anchor kit comprising:

a plurality of ground anchors, each said ground anchor comprising:

a base member for being fitted in a hole within the ground and fixedly secured to the ground against removal thereof, said base member comprising a top part having an opening and defining a generally flat top surface thereof; and a movable anchoring member comprising an elongate body, a top part defining a generally flat top surface thereof and a mounting element positioned on the elongate body and longitudinally spaced apart from the top surface, the mounting element being for mounting a holding member thereto, the movable anchoring member being mounted to said base member via said opening, said movable anchoring member being movable between a non-anchoring position, wherein said movable anchoring member top surface forms a plane with said base member top surface and said mounting element is retracted, and an anchoring position, wherein said movable anchoring member top surface protrudes above said base member top surface and said mounting element is exposed;

wherein mounting the holding member to the mounting element prevents the movable anchoring member from moving from the anchoring position to the non-anchoring position; and wherein when said base member is fixedly secured to the ground, and said movable anchoring member is in said anchoring position with said holding member mounted thereto and to the structure, said ground anchor anchors the structure to the ground.

* * * * *